US010262595B2

(12) United States Patent
Zhang

(10) Patent No.: US 10,262,595 B2
(45) Date of Patent: Apr. 16, 2019

(54) PIXEL CIRCUIT, CONTROL METHOD THEREOF, AND DISPLAY PANEL

(71) Applicant: Wuhan China Star Optoelectronics Semiconductor Display Technology Co., Ltd., Wuhan, Hubei (CN)

(72) Inventor: Di Zhang, Guangdong (CN)

(73) Assignee: Wuhan China Star Optoelectronics Semiconductor Display Technology Co., Ltd., Wuhan, Hubei (CN)

( * ) Notice: Subject to any disclaimer, the term of this patent is extended or adjusted under 35 U.S.C. 154(b) by 0 days.

(21) Appl. No.: 15/577,238

(22) PCT Filed: Sep. 14, 2017

(86) PCT No.: PCT/CN2017/101670
§ 371 (c)(1),
(2) Date: Nov. 27, 2017

(87) PCT Pub. No.: WO2019/000650
PCT Pub. Date: Jan. 3, 2019

(65) Prior Publication Data

US 2019/0005882 A1 Jan. 3, 2019

(30) Foreign Application Priority Data

Jun. 28, 2017 (CN) ..... 2017 1 0507803

(51) Int. Cl.
*G09G 3/3258* (2016.01)

(52) U.S. Cl.
CPC ... *G09G 3/3258* (2013.01); *G09G 2300/0819* (2013.01); *G09G 2310/08* (2013.01); *G09G 2320/045* (2013.01)

(58) Field of Classification Search
CPC ..... G09G 3/3258; G09G 2300/0819; G09G 2310/08; G09G 2310/045
See application file for complete search history.

(56) References Cited

U.S. PATENT DOCUMENTS

2011/0122324 A1 5/2011 Yamashita et al.
2014/0168194 A1 6/2014 Kong et al.
(Continued)

FOREIGN PATENT DOCUMENTS

CN 105741779 A 7/2016
CN 105741781 A 7/2016
(Continued)

OTHER PUBLICATIONS

U.S. Appl. No. 14/728,844, dated Feb. 11, 2016, Jae Keun Lim et al.

*Primary Examiner* — Peter D McLoone
(74) *Attorney, Agent, or Firm* — Andrew C. Cheng

(57) ABSTRACT

A pixel circuit is disclosed, including an electroluminescent element, first, second, third, fourth and fifth switching tubes, first and second capacitors. The first switching tube has first end connected to second end of fourth switching tube, second end connected to first end of electroluminescent element, first control end connected to second end of second switching tube; the second switching tube has first end inputting first timing signal, control end inputting second timing signal; the first capacitor has first end connected to first control end of first switching tube; the third switching tube has second end connected to second control end of first switching tube, control end inputting third timing signal; the second capacitor has first end connected to second control end of first switching tube, second end connected to first end of electroluminescent element; the fourth switching tube has control end inputting fourth timing signal.

20 Claims, 4 Drawing Sheets

(56) References Cited

U.S. PATENT DOCUMENTS

| | | | | |
|---|---|---|---|---|
| 2017/0249903 | A1* | 8/2017 | Xiang | G09G 3/3258 |
| 2017/0249913 | A1 | 8/2017 | Kim et al. | |

FOREIGN PATENT DOCUMENTS

| | | | |
|---|---|---|---|
| CN | 106504707 | A | 3/2017 |
| JP | 2003273228 | A | 9/2003 |

* cited by examiner

PIXEL CIRCUIT, CONTROL METHOD THEREOF, AND DISPLAY PANEL

BACKGROUND OF THE INVENTION

1. Field of the Invention

The present invention relates to the field of display techniques, and in particular to a pixel circuit, control method thereof, and display panel.

2. The Related Arts

As the liquid crystal display (LCD) panel technology continues to progress, the trend of demands on larger-size, higher resolution to achieve more stimulus visual effect poses higher demands on the panel manufacturing process, material and technique. Indium gallium zinc oxide (IGZO) material, and is a channel layer material used in the new generation thin film transistor (TFT), and also considered as one of the most promising materials in the active-matrix organic light-emitting diode (AMOLED) pixel design with the advantages of relatively simple process, high electron migration rate and good transparency. Also, because AMOLED pixel circuit is sensitive, which affects user experience, various compensation circuits, such as, voltage compensation, current compensation, hybrid compensation, external compensation, and so on, for AMOLED circuit are devised. With the dual-channel effect of IGZO material, the TFT of the pixel circuit comprises dual-gate. For the dual-gate pixel circuit, the compensation to the threshold voltage of the driving TFT and the IGZO migration rate suffers from the issues of complicated circuit structure of poor compensation result.

SUMMARY OF THE INVENTION

The present invention provides a pixel circuit, control method thereof, and display panel, able to compensate the threshold voltage of the switching tube and electron migration rate change on the condition of simple structure of pixel circuit.

To overcome the shortcomings of the known technique, the present invention provides a pixel circuit, comprising: an electroluminescent element, a first switching tube, a second switching tube, a third switching tube, a fourth switching tube, a fifth switching tube, a first capacitor, and a second capacitor; the first switching tube having a first end connected to a second end of the fourth switching tube, a second end connected to a first end of the electroluminescent element, and a first control end connected to a second end of the second switching tube; the second switching tube having a first end for inputting a first timing signal, and a control end for inputting a second timing signal; the first capacitor having a first end connected to the first control end of the first switching tube, and a second end connected to a first voltage; the third switching tube having a first end connected to a second voltage, a second end connected to a second control end of the first switching tube, and a control end for inputting a third timing signal; the second capacitor having a first end connected to the second control end of the first switching tube, and a second end connected to the first end of the electroluminescent element; the fourth switching tube having a first end connected to a third voltage, and a control end for inputting a fourth timing signal; the fifth switching tube having a first end connected to the second end of the second capacitor, a second end connected to a fourth voltage, and a control end for inputting a fifth timing signal; the electroluminescent element having a second end connected to a fifth voltage; wherein the first control end of the first switching tube being a bottom gate and the second control end of the first switching tube being a top gate, the first switching tube, the second switching tube, the third switching tube, the fourth switching tube, and the fifth switching tube all being N-type thin film transistor (TFT).

To overcome the shortcomings of the known technique, the present invention also provides a display panel comprising a pixel circuit, and the pixel circuit further comprising: an electroluminescent element, a first switching tube, a second switching tube, a third switching tube, a fourth switching tube, a fifth switching tube, a first capacitor, and a second capacitor; the first switching tube having a first end connected to a second end of the fourth switching tube, a second end connected to a first end of the electroluminescent element, and a first control end connected to a second end of the second switching tube; the second switching tube having a first end for inputting a first timing signal, and a control end for inputting a second timing signal; the first capacitor having a first end connected to the first control end of the first switching tube, and a second end connected to a first voltage; the third switching tube having a first end connected to a second voltage, a second end connected to a second control end of the first switching tube, and a control end for inputting a third timing signal; the second capacitor having a first end connected to the second control end of the first switching tube, and a second end connected to the first end of the electroluminescent element; the fourth switching tube having a first end connected to a third voltage, and a control end for inputting a fourth timing signal; the fifth switching tube having a first end connected to the second end of the second capacitor, a second end connected to a fourth voltage, and a control end for inputting a fifth timing signal; the electroluminescent element having a second end connected to a fifth voltage.

To overcome the shortcomings of the known technique, the present invention also provides a control method of pixel circuit, the pixel circuit comprising: an electroluminescent element, a first switching tube, a second switching tube, a third switching tube, a fourth switching tube, a fifth switching tube, a first capacitor, and a second capacitor; the first switching tube having a first end connected to a second end of the fourth switching tube, a second end connected to a first end of the electroluminescent element, and a first control end connected to a second end of the second switching tube; the second switching tube having a first end for inputting a first timing signal, and a control end for inputting a second timing signal; the first capacitor having a first end connected to the first control end of the first switching tube, and a second end connected to a first voltage; the third switching tube having a first end connected to a second voltage, a second end connected to a second control end of the first switching tube, and a control end for inputting a third timing signal; the second capacitor having a first end connected to the second control end of the first switching tube, and a second end connected to the first end of the electroluminescent element; the fourth switching tube having a first end connected to a third voltage, and a control end for inputting a fourth timing signal; the fifth switching tube having a first end connected to the second end of the second capacitor, a second end connected to a fourth voltage, and a control end for inputting a fifth timing signal; the electroluminescent element having a second end connected to a fifth voltage; and the control method comprising: in a first stage, using the second timing signal to switch on the second switching tube, using the third timing signal to switch on the third switching tube, using the fifth timing signal to switch on the fifth switching tube, using the fourth timing signal to switching off the fourth switching tube; in a second stage, using the second timing signal to switch on the second switching tube, using the third timing signal to switch on the third switching tube, using the fourth timing signal to switch on the fourth switching tube, and using the fifth timing signal to switch off the fifth switching tube; in a third stage, using the second timing signal to switch on the second switching tube, using the fourth timing signal to switch on the fourth switching tube, using the fifth timing signal to switch off the fifth switching tube, and using the third timing signal to switch off the third switching tube; in a fourth stage, using the second timing signal to switch off the second switching tube, using the fourth timing signal to switch on the fourth switching tube, using the fifth timing signal to switch off the fifth switching tube, and using the third timing signal to switch off the third switching tube.

Compared to the known techniques, the present invention provides the following advantages: the present invention uses the first control end of the first switching tube to write data signal, uses the second troll end of the first switching tube to capture threshold voltage to achieve the functions of compensating the threshold voltage of pixel circuit and electron migration rate.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description. Apparently, the described embodiments are merely some embodiments of the present invention, instead of all embodiments. All other embodiments based on embodiments in the present invention and obtained by those skilled in the art without departing from the creative work of the present invention are within the scope of the present invention.

Figure 1:
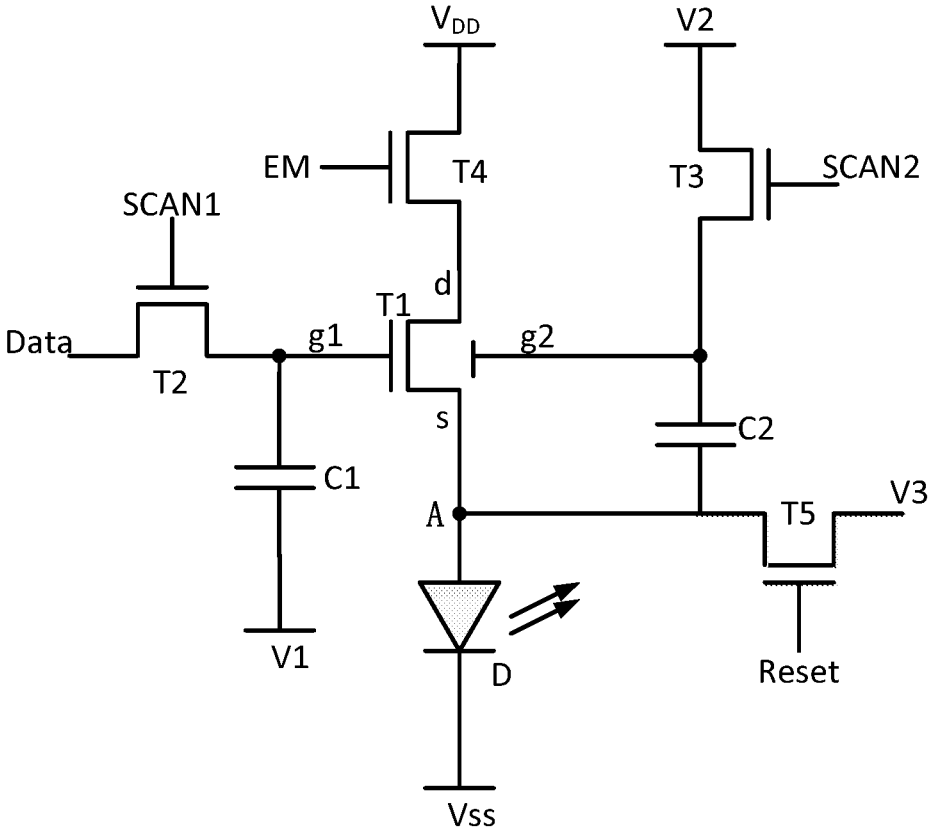
FIG. 1 is a schematic view showing the structure of a pixel circuit provided by the first embodiment of the present invention.

Refer to FIG. 1. FIG. 1 is a schematic view showing the structure of a pixel circuit provided by the first embodiment of the present invention. In the present embodiment, the pixel circuit comprises: an electroluminescent element D, a first switching tube T1, a second switching tube T2, a third switching tube T3, a fourth switching tube T4, a fifth switching tube T5, a first capacitor C1, and a second capacitor C2.

The first switching tube T1 has a first end d connected to a second end of the fourth switching tube T4, a second end s connected to a first end of the electroluminescent element D, and a first control end connected to a second end of the second switching tube T2.

The second switching tube T2 has a first end for inputting a first timing signal Data, and a control end for inputting a second timing signal SCAN1.

The first capacitor C1 has a first end connected to the first control end g1 of the first switching tube T1, and a second end connected to a first voltage V1.

The third switching tube T3 has a first end connected to a second voltage V2, a second end connected to a second control end g2 of the first switching tube T1, and a control end for inputting a third timing signal SCAN2.

The second capacitor C2 has a first end connected to the second control end of the first switching tube T1, and a second end connected to the first end of the electroluminescent element D.

The fourth switching tube T4 has a first end connected to a third voltage VDD, and a control end for inputting a fourth timing signal EM.

The fifth switching tube T5 has a first end connected to the second end of the second capacitor C2, a second end connected to a fourth voltage V3, and a control end for inputting a fifth timing signal RESET.

The electroluminescent element D has a second end connected to a fifth voltage VSS.

Preferably, the first switching tube T1 us a dual-gate thin film transistor (TFT), the first control end g1 of the first switching tube T1 is a bottom gate and the second control end g2 of the first switching tube T2 is a top gate. The first end d of the first switching tube T1 is the drain, and the second end of the first switching tube T1 is the source.

Preferably, the first switching tube T1, the second switching tube T2, the third switching tube T3, the fourth switching tube T4, and the fifth switching tube T5 all are N-type TFTs.

Preferably, the electroluminescent element D is an organic light-emitting diode (OLED).

Preferably, the fourth voltage V3 is a constant voltage, and the fourth voltage V3 is less than the difference between the minimum voltage MIN(Vdata) of the first timing signal Data and the threshold voltage Vth of the first switching tube T1, i.e., $V3<MIN(Vdata)-Vth$.

Preferably, the second voltage V2 is also a constant voltage.

Figure 2:
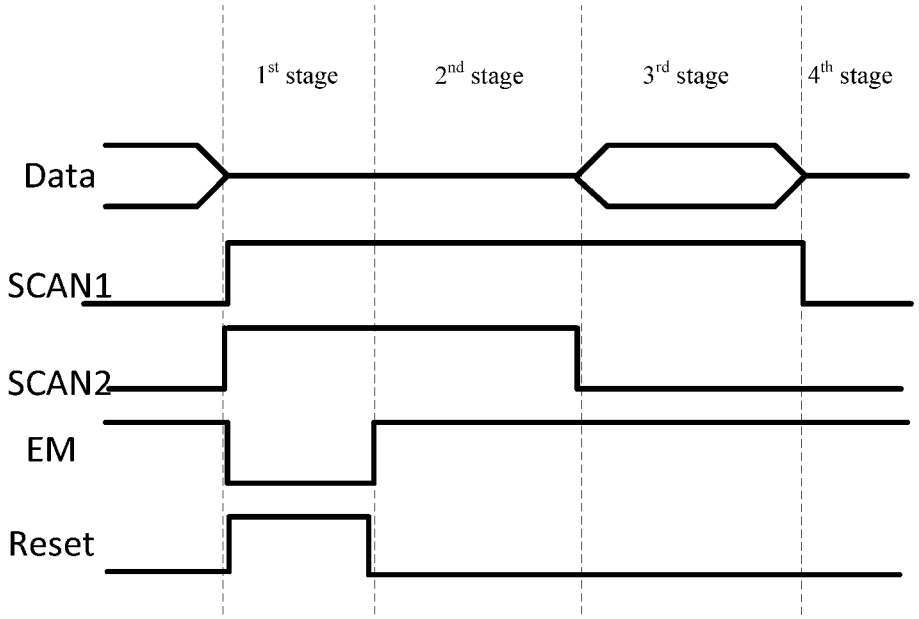
FIG. 2 is a schematic view showing the timing signals of the pixel circuit provided by the first embodiment of the present invention.

Refer to FIG. 2. FIG. 2 is a schematic view showing the timing signals of the pixel circuit provided by the first embodiment of the present invention.

Combing FIG. 1 and FIG. 2, the following description explains the operation principle behind the pixel circuit of the first embodiment of the present invention.

In the first stage, the second timing signal SCAN1, the third timing signal SCAN2, and the fifth timing signal RESET are high, and the fourth timing signal EM is low. The second timing signal SCAN1 is used to switch on the second switching tube T2, the third timing signal SCAN2 is used to switch on the third switching tube T3, and the fifth timing signal RESET is used to switch on the fifth switching tube T5. The voltage of the first timing signal Data in the first stage is a reference constant voltage Vref. Because V3<MIN (Vdata)−Vth, the reference constant voltage Vref is written into the first control end of the first switching tube T1 in the first stage, and the two electrodes of the first capacitor C1 and the second capacitor C2 are reset, prepared for subsequent compensation and data write-in.

In the second stage, the second timing signal SCAN1, the third timing signal SCAN2, and the fourth timing signal EM are high, and the fifth timing signal RESET is low. The second timing signal SCAN1 is used to switch on the second switching tube T2, the third timing signal SCAN2 is used to switch on the third switching tube T3, and the fourth timing signal EM is used to switch on the fourth switching tube T4, while the fifth timing signal RESET is used to switch off the fifth switching tube T5. In the second stage, the voltage at node A is raised to Vref−Vth, and the second capacitor C2 stores the threshold voltage Vth of the first switching tube T1.

In the third stage, the second timing signal SCAN1 and the fourth timing signal EM are high, and the third timing signal SCAN2 and the fifth timing signal RESET are low. The second timing signal SCAN1 is used to switch on the second switching tube T2, and the fourth timing signal EM is used to switch on the fourth switching tube T4, while the fifth timing signal RESET is used to switch off the fifth switching tube T5, and the third timing signal SCAN2 is used to switch off the third switching tube T3. In the third stage, the first timing signal Data is a data signal, and the data signal is written from a data line into the first control end g1 of the first switching tube T1, and the second end s of the first switching tube T1 is charged to a voltage Voled, wherein the voltage Voled is determined by the voltage difference of the electroluminescent element D in the light-emission stage and the fifth voltage VSS. The second control end g2 of the first switching tube T1 becomes V2−Vref+Vth+Voled under the coupling effect of the second capacitor C2. Therefore, in the third stage, the voltage Vgs2 between the second control end g2 and the second end s of the first switching tube T1 is Vgs2=V2−Vref+Vth, and the voltage Vgs1 between the first control end g1 and the second end s of the first switching tube T1 is Vgs1=Vdata−Voled.

In the fourth stage, the fourth timing signal EM is high, and the second timing signal SCAN1, the third timing signal SCAN2 and the fifth timing signal RESET are low. The second timing signal SCAN1 is used to switch off the second switching tube T2, and the fourth timing signal EM is used to switch on the fourth switching tube T4, the fifth timing signal RESET is used to switch off the fifth switching tube T5, and the third timing signal SCAN2 is used to switch off the third switching tube T3. In the fourth stage, due to the maintenance effect of the first capacitor C1 and the second capacitor C2, the voltage Vgs2 between the second control end g2 and the second end s of the first switching tube T1 is maintained at Vgs2=V2−Vref+Vth, as in the third stage, and the voltage Vgs1 between the first control end g1 and the second end s of the first switching tube T1 is maintained at Vgs1=Vdata−Voled, also as in the third stage. Therefore, the light-emitting current Ioled flowing through the electroluminescent element D is:

$$Ioled=k(Vgs-Vth)^2 \quad \text{(Eq.1-1)}$$

$$Ioled=k[Vgs1+(1/Etop)*Vgs2-Vth]^2 \quad \text{(Eq.1-2)}$$

Wherein Etop is a coefficient of the second control end, i.e., the top gate, of the first switching tube T1, and is defined as Etop=ΔVth/ΔVge2, wherein Etop is defaulted to be 1.

Thus, by substituting Vgs1 and Vgs2, the following is obtained:

$$Ioled=k(Vdata-Voled+V2-Vref)^2 \quad \text{(Eq.1-3)}$$

As shown in Eq. 1-3, the light-emitting current Ioled of the electroluminescent element D is related to the second voltage V2 and the reference constant voltage Vref. Therefore, the pixel circuit of the present embodiment compensates the effect caused by the change of the threshold voltage Vth of the first switching tube T1. In the mean time, the above can prevent the light-emission of the electroluminescent element D from the effect of the electron migration rate change in the process of negative feedback of the voltage at the first end (i.e., the anode) of the electroluminescent element D during the electroluminescent element D emits light.

Preferably, the first stage is a reset stage, the second stage is a compensation stage, the third stage is a write-in stage, and the fourth-stage is a light-emission stage.

Figure 3:
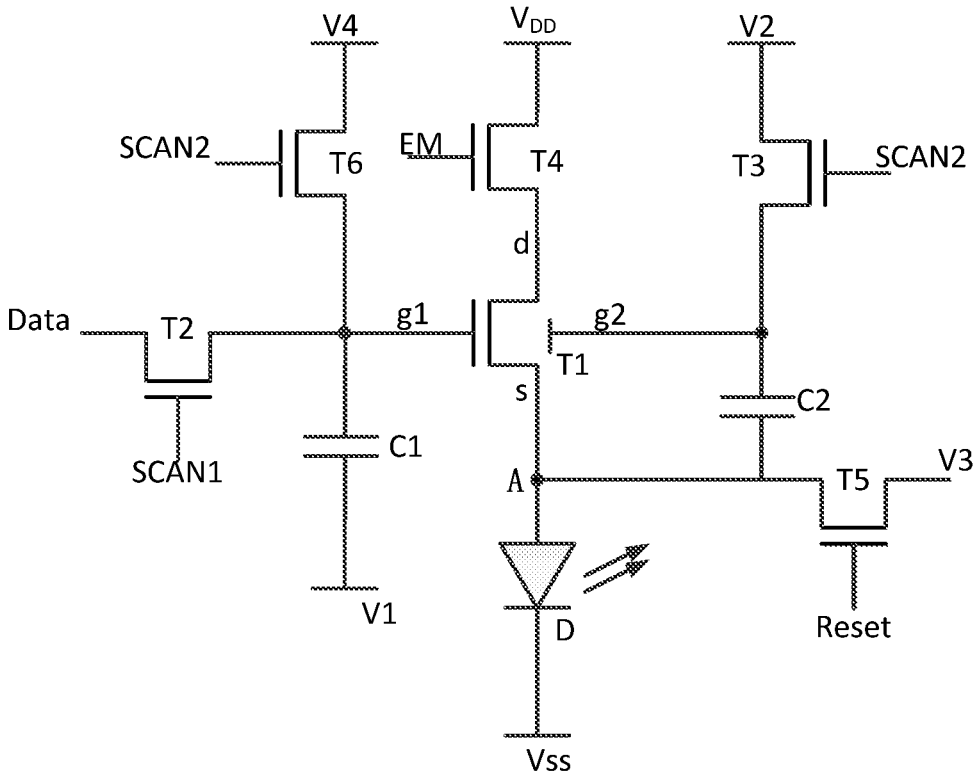
FIG. 3 is a schematic view showing the structure of a pixel circuit provided by the second embodiment of the present invention.

Refer to FIG. 3. FIG. 3 is a schematic view showing the structure of a pixel circuit provided by the second embodiment of the present invention. The present embodiment differs from the first embodiment in that the pixel circuit further comprises a sixth switching tube T6. The sixth switching tube T6 has a first end connected to a fifth voltage V4, a second end connected to the first control end g1 of the first switching tube T1, and a control end for inputting the third timing signal SCAN2.

The fifth voltage V4 is a constant voltage, and equals to the reference constant voltage Vref.

Figure 4:
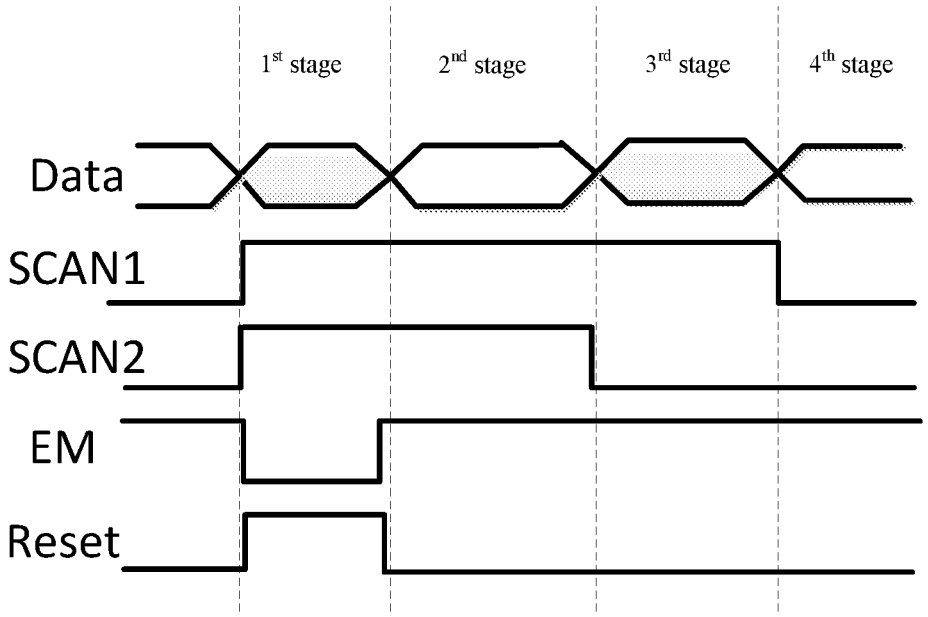
FIG. 4 is a schematic view showing the timing signals of the pixel circuit provided by the second embodiment of the present invention.

Refer to FIG. 4. FIG. 4 is a schematic view showing the timing signals of the pixel circuit provided by the second embodiment of the present invention.

Combing FIG. 3 and FIG. 4, the following description explains the operation principle behind the pixel circuit of the second embodiment of the present invention.

In the present embodiment, the reference constant Vref in the first stage is provided by the fifth voltage V4, which is different from the first embodiment wherein the reference constant Vref in the first stage is provided by the first timing signal Data, so as to avoid the first timing signal Data from writing into the reference constant voltage Vref and data signal alternatingly in the first stage and the second stage.

In the first stage, the second timing signal SCAN1, the third timing signal SCAN2, and the fifth timing signal RESET are high, and the fourth timing signal EM is low. The second timing signal SCAN1 is used to switch on the second switching tube T2, the third timing signal SCAN2 is used to switch on the third switching tube T3, the fifth timing signal RESET is used to switch on the fifth switching tube T5, and the third timing signal SCAN2 is used to switch on the sixth switching tube T6. Because V3<MIN(Vdata)−Vth, the reference constant voltage Vref provided by the fifth voltage V4 is written into the first control end of the first switching tube T1 in the first stage, and the two electrodes of the first capacitor C1 and the second capacitor C2 are reset, prepared for subsequent compensation and data write-in.

In the second stage, the second timing signal SCAN1, the third timing signal SCAN2, and the fourth timing signal EM are high, and the fifth timing signal RESET is low. The second timing signal SCAN1 is used to switch on the second switching tube T2, the third timing signal SCAN2 is used to switch on the third switching tube T3, and the fourth timing signal EM is used to switch on the fourth switching tube T4, the fifth timing signal RESET is used to switch off the fifth switching tube T5, and the third timing signal SCAN2 is used to switch on the sixth switching tube T6. In the second stage, the voltage at node A is raised to Vref-Vth, and the second capacitor C2 stores the threshold voltage Vth of the first switching tube T1.

In the third stage, the second timing signal SCAN1 and the fourth timing signal EM are high, and the third timing signal SCAN2 and the fifth timing signal RESET are low. The second timing signal SCAN1 is used to switch on the second switching tube T2, and the fourth timing signal EM is used to switch on the fourth switching tube T4, while the fifth timing signal RESET is used to switch off the fifth switching tube T5, the third timing signal SCAN2 is used to switch off the third switching tube T3, and the third timing signal SCAN2 is used to switch off the sixth switching tube T6. In the third stage, the first timing signal Data is a data signal, and the data signal is written from a data line into the first control end g1 of the first switching tube T1, and the second end s of the first switching tube T1 is charged to a voltage Voled, wherein the voltage Voled is determined by the voltage difference of the electroluminescent element D in the light-emission stage and the fifth voltage VSS. The second control end g2 of the first switching tube T1 becomes V2−Vref+Vth+Voled under the coupling effect of the second capacitor C2. Therefore, in the third stage, the voltage Vgs2 between the second control end g2 and the second end s of the first switching tube T1 is Vgs2=V2−Vref+Vth, and the voltage Vgs1 between the first control end g1 and the second end s of the first switching tube T1 is Vgs1=Vdata−Voled.

In the fourth stage, the fourth timing signal EM is high, and the second timing signal SCAN1, the third timing signal SCAN2 and the fifth timing signal RESET are low. The second timing signal SCAN1 is used to switch off the second switching tube T2, and the fourth timing signal EM is used to switch on the fourth switching tube T4, the fifth timing signal RESET is used to switch off the fifth switching tube T5, the third timing signal SCAN2 is used to switch off the third switching tube T3, and the third timing signal SCAN2 is used to switch off the sixth switching tube T6. In the fourth stage, due to the maintenance effect of the first capacitor C1 and the second capacitor C2, the voltage Vgs2 between the second control end g2 and the second end s of the first switching tube T1 is maintained at Vgs2=V2−Vref+Vth, as in the third stage, and the voltage Vgs1 between the first control end g1 and the second end s of the first switching tube T1 is maintained at Vgs1=Vdata−Voled, also as in the third stage. Therefore, in the fourth stage, the light-emitting current Ioled flowing through the electroluminescent element D is:

$$Ioled=k(Vgs-Vth)^2 \quad \text{(Eq.1-1)}$$

$$Ioled=k[Vgs1+(1/Etop)*Vgs2-Vth]^2 \quad \text{(Eq.1-2)}$$

Wherein Etop is a coefficient of the second control end, i.e., the top gate, of the first switching tube T1, and is defined as Etop=ΔVth/ΔVge2, wherein Etop is defaulted to be 1.

Thus, by substituting Vgs1 and Vgs2, the following is obtained:

$$Ioled=k(Vdata-Voled+V2-Vref)^2 \quad \text{(Eq.1-3)}$$

As shown in Eq. 1-3, the light-emitting current Ioled of the electroluminescent element D is related to the second voltage V2 and the reference constant voltage Vref. Therefore, the pixel circuit of the present embodiment compensates the effect caused by the change of the threshold voltage Vth of the first switching tube T1. In the mean time, the above can prevent the light-emission of the electroluminescent element D from the effect of the electron migration rate change in the process of negative feedback of the voltage at the first end (i.e., the anode) of the electroluminescent element D during the electroluminescent element D emits light.

Figure 5:
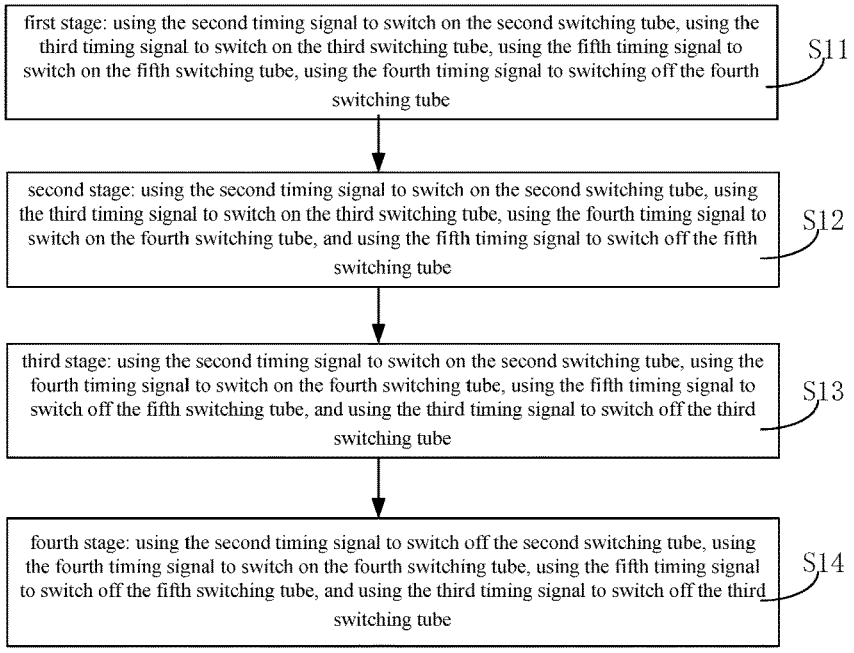
FIG. 5 is a schematic view showing a flowchart of the control method of pixel circuit provided by the third embodiment of the present invention.

Refer to FIG. 5. FIG. 5 is a schematic view showing a flowchart of the control method of pixel circuit provided by the third embodiment of the present invention. In the present embodiment, the control method of pixel circuit is applied to controlling the pixel circuit in the first embodiment of the present invention. The control method of pixel circuit comprises:

Step S11: in a first stage, using the second timing signal to switch on the second switching tube, using the third timing signal to switch on the third switching tube, using the fifth timing signal to switch on the fifth switching tube, using the fourth timing signal to switching off the fourth switching tube.

Step S12: in a second stage, using the second timing signal to switch on the second switching tube, using the third timing signal to switch on the third switching tube, using the fourth timing signal to switch on the fourth switching tube, and using the fifth timing signal to switch off the fifth switching tube.

Step S13: in a third stage, using the second timing signal to switch on the second switching tube, using the fourth timing signal to switch on the fourth switching tube, using the fifth timing signal to switch off the fifth switching tube, and using the third timing signal to switch off the third switching tube.

Step S14: in a fourth stage, using the second timing signal to switch off the second switching tube, using the fourth timing signal to switch on the fourth switching tube, using the fifth timing signal to switch off the fifth switching tube, and using the third timing signal to switch off the third switching tube.

The description of the above steps can be referred to the description of the pixel circuit in the first embodiment, and will not be repeated here.

Figure 6:
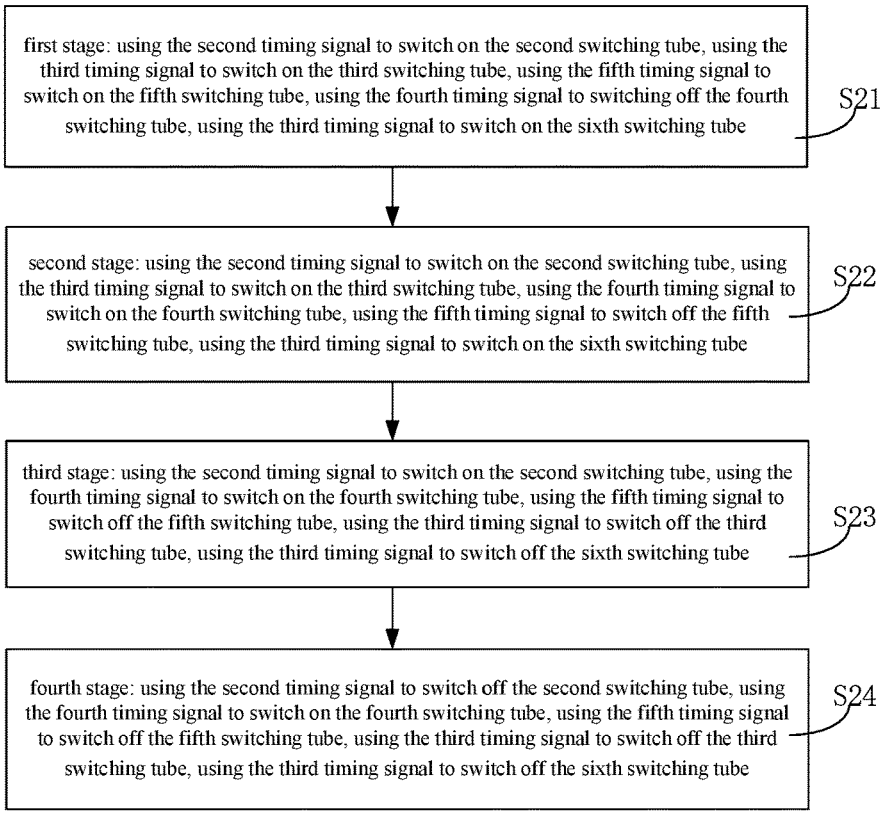
FIG. 6 is a schematic view showing a flowchart of the control method of pixel circuit provided by the fourth embodiment of the present invention.

Refer to FIG. 6. FIG. 6 is a schematic view showing a flowchart of the control method of pixel circuit provided by the fourth embodiment of the present invention. In the present embodiment, the control method of pixel circuit is applied to controlling the pixel circuit in the second embodiment of the present invention. The control method of pixel circuit comprises:

Step S21: in a first stage, using the second timing signal to switch on the second switching tube, using the third timing signal to switch on the third switching tube, using the fifth timing signal to switch on the fifth switching tube, using the fourth timing signal to switching off the fourth switching tube, and using the third timing signal to switch on the sixth switching tube.

Step S22: in a second stage, using the second timing signal to switch on the second switching tube, using the third timing signal to switch on the third switching tube, using the fourth timing signal to switch on the fourth switching tube, using the fifth timing signal to switch off the fifth switching tube, and using the third timing signal to switch on the sixth switching tube.

Step S23: in a third stage, using the second timing signal to switch on the second switching tube, using the fourth timing signal to switch on the fourth switching tube, using the fifth timing signal to switch off the fifth switching tube, and using the third timing signal to switch off the sixth switching tube.

Step S24: in a fourth stage, using the second timing signal to switch off the second switching tube, using the fourth timing signal to switch on the fourth switching tube, using the fifth timing signal to switch off the fifth switching tube, using the third timing signal to switch off the third switching tube, and using the third timing signal to switch off the sixth switching tube.

The description of the above steps can be referred to the description of the pixel circuit in the second embodiment, and will not be repeated here.

Figure 7:
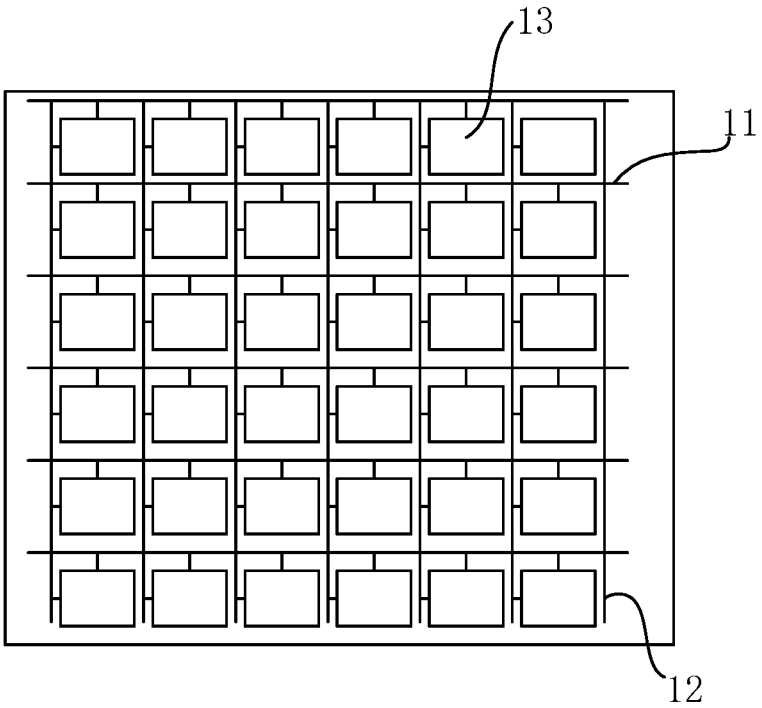
FIG. 7 is a schematic view showing the showing the structure of a display panel provided by the fifth embodiment of the present invention.

Refer to FIG. 7. FIG. 7 is a schematic view showing the showing the structure of a display panel provided by the fifth embodiment of the present invention. In the present embodiment, the display panel comprises a plurality of data lines 11 arranged in parallel, a plurality of scan lines 12 arranged in parallel and disposed perpendicularly intersecting the plurality of data lines 11, a pixel circuit 13 disposed inside two adjacent data lines and two adjacent scan lines. The pixel circuit 13 can be a pixel circuit in any of the above embodiments. In the above embodiments, the first timing signal Data can be provided by corresponding data line 11, the second timing signal SCAN1 and the third timing signal SCAN2 can be provided by corresponding scan lines 12.

Compared to prior art, the present invention achieves the functions of compensating threshold voltage of the pixel circuit and electron migration rate by using the first control end of the first switching tube to write data signal and using the second control end of the first switching tube to capture the threshold voltage.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A pixel circuit, comprising: an electroluminescent element, a first switching tube, a second switching tube, a third switching tube, a fourth switching tube, a fifth switching tube, a first capacitor, and a second capacitor;

the first switching tube having a first end connected to a second end of the fourth switching tube, a second end connected to a first end of the electroluminescent element, and a first control end connected to a second end of the second switching tube;

the second switching tube having a first end for inputting a first timing signal, and a control end for inputting a second timing signal;

the first capacitor having a first end connected to the first control end of the first switching tube, and a second end connected to a first voltage;

the third switching tube having a first end connected to a second voltage, a second end connected to a second control end of the first switching tube, and a control end for inputting a third timing signal;

the second capacitor having a first end connected to the second control end of the first switching tube, and a second end connected to the first end of the electroluminescent element;

the fourth switching tube having a first end connected to a third voltage, and a control end for inputting a fourth timing signal;

the fifth switching tube having a first end connected to the second end of the second capacitor, a second end connected to a fourth voltage, and a control end for inputting a fifth timing signal;

the electroluminescent element having a second end connected to a fifth voltage;

wherein the first control end of the first switching tube being a bottom gate and the second control end of the first switching tube being a top gate, the first switching tube, the second switching tube, the third switching tube, the fourth switching tube, and the fifth switching tube all being N-type thin film transistor (TFT).

2. The pixel circuit as claimed in claim 1, wherein the pixel circuit further comprises a sixth switching tube, and the sixth switching tube has a first end connected to a fifth voltage, a second end connected to the first control end of the first switching tube, and a control end for inputting the third timing signal.

3. The pixel circuit as claimed in claim 2, wherein the sixth switching tube is an N-type TFT.

4. The pixel circuit as claimed in claim 1, wherein the electroluminescent element is an organic light-emitting diode (OLED).

5. The pixel circuit as claimed in claim 1, wherein the fourth voltage is a constant voltage, the fourth voltage is less than the difference between the minimum voltage of the first timing signal and the threshold voltage of the first switching tube.

6. The pixel circuit as claimed in claim 1, wherein the second voltage is a constant voltage.

7. A display panel, comprises a pixel circuit, wherein the pixel circuit comprising: a first switching tube, a second switching tube, a third switching tube, a fourth switching tube, a fifth switching tube, a first capacitor, and a second capacitor;

the second switching tube having a first end for inputting a first timing signal, and a control end for inputting a second timing signal;

the first capacitor having a first end connected to the first control end of the first switching tube, and a second end connected to a first voltage;

the third switching tube having a first end connected to a second voltage, a second end connected to a second control end of the first switching tube, and a control end for inputting a third timing signal;

the second capacitor having a first end connected to the second control end of the first switching tube, and a second end connected to the first end of the electroluminescent element;

the fourth switching tube having a first end connected to a third voltage, and a control end for inputting a fourth timing signal;

the fifth switching tube having a first end connected to the second end of the second capacitor, a second end connected to a fourth voltage, and a control end for inputting a fifth timing signal;

the electroluminescent element having a second end connected to a fifth voltage.

8. The display panel as claimed in claim 7, wherein the first switching tube is a dual-gate thin film transistor (TFT), and the first control end of the first switching tube is a bottom gate and the second control end of the first switching tube is a top gate.

9. The display panel as claimed in claim 8, wherein the sixth switching tube is an N-type TFT.

10. The display panel as claimed in claim 7, wherein the first switching tube, the second switching tube, the third switching tube, the fourth switching tube, and the fifth switching tube all are N-type TFTs.

11. The display panel as claimed in claim 7, wherein the pixel circuit further comprises a sixth switching tube, and the sixth switching tube has a first end connected to a fifth voltage, a second end connected to the first control end of the first switching tube, and a control end for inputting the third timing signal.

12. The display panel as claimed in claim 7, wherein the electroluminescent element is an organic light-emitting diode (OLED).

13. The pixel circuit as claimed in claim 7, wherein the fourth voltage is a constant voltage, the fourth voltage is less than the difference between the minimum voltage of the first timing signal and the threshold voltage of the first switching tube.

14. The display panel as claimed in claim 7, wherein the second voltage is a constant voltage.

15. A control method of pixel circuit, wherein the pixel circuit comprising a first switching tube, a second switching tube, a third switching tube, a fourth switching tube, a fifth switching tube, a first capacitor, and a second capacitor;

the second switching tube having a first end for inputting a first timing signal, and a control end for inputting a second timing signal;

the first capacitor having a first end connected to the first control end of the first switching tube, and a second end connected to a first voltage;

the third switching tube having a first end connected to a second voltage, a second end connected to a second control end of the first switching tube, and a control end for inputting a third timing signal;

the second capacitor having a first end connected to the second control end of the first switching tube, and a second end connected to the first end of the electroluminescent element;

the fourth switching tube having a first end connected to a third voltage, and a control end for inputting a fourth timing signal;

the fifth switching tube having a first end connected to the second end of the second capacitor, a second end connected to a fourth voltage, and a control end for inputting a fifth timing signal;

the electroluminescent element having a second end connected to a fifth voltage;

the control method comprising:

in a first stage, using the second timing signal to switch on the second switching tube, using the third timing signal to switch on the third switching tube, using the fifth timing signal to switch on the fifth switching tube, using the fourth timing signal to switching off the fourth switching tube;

in a second stage, using the second timing signal to switch on the second switching tube, using the third timing signal to switch on the third switching tube, using the fourth timing signal to switch on the fourth switching tube, and using the fifth timing signal to switch off the fifth switching tube;

in a third stage, using the second timing signal to switch on the second switching tube, using the fourth timing signal to switch on the fourth switching tube, using the fifth timing signal to switch off the fifth switching tube, and using the third timing signal to switch off the third switching tube;

in a fourth stage, using the second timing signal to switch off the second switching tube, using the fourth timing signal to switch on the fourth switching tube, using the fifth timing signal to switch off the fifth switching tube, and using the third timing signal to switch off the third switching tube.

16. The control method as claimed in claim 15, wherein the pixel circuit further comprises a sixth switching tube, and the sixth switching tube has a first end connected to a fifth voltage, a second end connected to the first control end of the first switching tube, and a control end for inputting the third timing signal;

the control method further comprises:

in the first stage, using the third timing signal to switch on the sixth switching tube;

in the second stage, using the third timing signal to switch on the sixth switching tube;

in the third stage, using the third timing signal to switch off the sixth switching tube;

in the fourth stage, using the third timing signal to switch off the sixth switching tube.

17. The control method as claimed in claim 15, wherein the first switching tube is a dual-gate thin film transistor (TFT), and the first control end of the first switching tube is a bottom gate and the second control end of the first switching tube is a top gate.

18. The control method as claimed in claim 15, wherein the first switching tube is a dual-gate thin film transistor (TFT), and the first control end of the first switching tube is a bottom gate and the second control end of the first switching tube is a top gate.

19. The control method as claimed in claim 15, wherein the fourth voltage is a constant voltage, the fourth voltage is less than the difference between the minimum voltage of the first timing signal and the threshold voltage of the first switching tube.

20. The control method as claimed in claim 15, wherein the first stage is a reset stage, the second stage is a compensation stage, the third stage is a write-in stage, and the fourth stage is a light-emission stage.

* * * * *